US006421025B1

(12) United States Patent
Drize et al.

(10) Patent No.: US 6,421,025 B1
(45) Date of Patent: Jul. 16, 2002

(54) ANTENNA FOR SMALL-DIMENSION STATIONS FOR DETECTING AND TRACKING TARGETS AND ROCKETS

(75) Inventors: Iosif Matveevich Drize; Sofiya Alexeevna Barsukova, both of Moscow; Alexandr Vasilievich Fedosov, Udelnaya; Serafim Serafimovich Kozlov; Vadim Alexeevich Ryzhikov, both of Moscow, all of (RU)

(73) Assignee: Nauchno-Issledovatelsky Electromekhanichesky Institut, Moscow (RU)

( * ) Notice: Subject to any disclaimer, the term of this patent is extended or adjusted under 35 U.S.C. 154(b) by 0 days.

(21) Appl. No.: 09/581,858

(22) PCT Filed: Sep. 28, 1999

(86) PCT No.: PCT/EA99/00008

§ 371 (c)(1),
(2), (4) Date: Aug. 29, 2000

(87) PCT Pub. No.: WO00/24087

PCT Pub. Date: Apr. 27, 2000

(30) Foreign Application Priority Data

Oct. 19, 1998 (EP) ..... 199900051

(51) Int. Cl.[7] ..... H01Q 3/26
(52) U.S. Cl. ..... 343/853; 342/371
(58) Field of Search ..... 343/778, 853; 342/371, 368; H01Q 3/00, 3/26

(56) References Cited

U.S. PATENT DOCUMENTS 3,576,579 A * 4/1971 Appelbaum et al. ..... 343/778

FOREIGN PATENT DOCUMENTS

| | | |
|---|---|---|
| EP | 0368121 | 5/1990 |
| EP | 0417689 | 3/1991 |
| RU | 2100879 | 12/1997 |
| SU | 1064358 | 12/1983 |

OTHER PUBLICATIONS

English Specification of invention for SU 1064358 Dated Dec. 30, 1983.
English Specification of invention and claims for Ru 2100879 Dated Dec. 27, 1997.
"Radar installations (theory and design principles)" Edited by V.V. Grigorina–Ryabova, Pubusher Sovetskoe radio, Moscow (1970) pp.430–431.

* cited by examiner

*Primary Examiner*—Michael C. Wimer
(74) *Attorney, Agent, or Firm*—Ladas & Parry

(57) ABSTRACT

An antenna that can be used in close combat weapon control radar systems where a light-weight, compact, cheap antenna with electronic scanning of the directional radiation patterns within a restricted sector of angles is desirable is in the form of a few-element phased antenna array (PAA) comprising feed, phasing, radiation and control systems and a microwave signal processing section. The feed system includes power dividers of series or parallel type which ensure a predetermined amplitude distribution on the surface of the antenna. The phasing system consists of electronic phase shifters which ensure a phase distribution within the aperture of the antenna that corresponds to forming the directional radiation pattern of a required shape in the predetermined direction. The radiation system consists of radiators which have the shape of their directional radiation patterns to ensure the operation of the antenna with a high surface utilization factor within the sector of scanning and the suppression of diffraction lobes (array lobes) beyond the predetermined sector.

6 Claims, 3 Drawing Sheets

ANTENNA FOR SMALL-DIMENSION STATIONS FOR DETECTING AND TRACKING TARGETS AND ROCKETS

BACKGROUND OF THE INVENTION

The invention relates to the field of microwave band antennae and can be used in designing antennae for small-size mobile radar antiaircraft-rocket systems for acquisition and tracking of targets and rockets as well as in microwave antenna equipment designed for other purposes.

It is known that such a system arranged, in the majority of cases, to be disposed on a single transport vehicle (a self-propelled chassis) must enable to scan the area in a target search, followed by tracking the targets thus acquired, that is, periodically determining the three coordinates of the targets in space and lashing the target motion lanes in order to make a decision to destroy a target. After rockets are fired out to destroy the targets, the system must ensure their lock-on and guidance at the targets thus being tracked down to the moment of their destruction. The necessity to solve these problems while arranging equipment on a single self-propelled chassis leads to imposing substantially higher requirements on an antenna-feeder system of such a radar station, many of these requirements being conflicting. Thus, for instance, in order to improve the radar resolution and improve accuracy in determining the angular coordinates of a target, it is necessary to form a sufficiently narrow directional radiation pattern of the antenna, but for scanning the area and locking on a rocket, the directional radiation pattern of the antenna must be wide enough. The antenna must ensure a high capacity of the radar station for simultaneous operation with several targets and rockets as well as adaptability to various widths of its directional radiation pattern—for this purpose, the antenna must have a high speed of response when the directional radiation pattern thereof is moving in space and its width is changing. At the same time, the antenna for the radar station of a small-size mobile antiaircraft-rocket system must have small overall dimensions and mass and low cost—factors which are frequently decisive in selecting the type of antennae.

The aforementioned requirements to an antenna for the radar station of a small-size antiaircraft-rocket system would be met to the largest extent by antennae of a phased array type with electronic scanning of their directional radiation patterns. Known in the art are antiaircraft-rocket systems which use antennae of the phased array type—for instance, a multi-functional radar station of the "PATRIOT" antiaircraft-rocket system, a radar station of the "AEGIS" shipboard antiaircraft-rocket system. However, the constructional features of phased antenna arrays as realized in providing antennae for the above-mentioned radar stations appear to be unacceptable when developing small-size target and rocket acquisition and tracking radar stations arranged to be disposed on a single self-propelled chassis, in connection with their rather high complexity, large overall dimensions and mass, and a high cost. This explains the fact that use is made of reflector-type antennae with electromechanical scanning of beam until recently in the known radar stations of small-size target and rocket acquisition and tracking systems. Such antennae are used in "Crotal" (France), "Roland" (France, Germany) and "Osa" (Russia) systems.

It is a reflector-type antenna for a target radar of the "Osa" antiaircraft-rocket system (see Technical Description of Combat Vehicle of Antiaircraft Rocket System "Osa-AKM", GP IEMZ, Ishevsk, 1980) that is taken to be the most relevant prior art prototype.

The antenna for that system comprises a radiating aperture (surface) and a microwave section. The radiating aperture is formed by a parabolic reflector of polarization-rotating type with a reflector-filter. The antenna surface is excited by means of a feed. The microwave section which comprises a system of E–H tees, a modulator, a slot bridge hybrid, a circulator, connects a radiator to a transmitter and a receiver of the radar station. Scanning of the directional radiation patterns within a predetermined angular sector is effected in azimuth and elevation planes by means of an electromechanical rotating device which comprises azimuth and elevation drives.

While meeting the requirements of simplicity, small overall dimensions and mass, and low cost as imposed on an antenna for the radar station of a mobile system, the antennae of the most relevant prior art prototype and analogues possess, when used with modern strike weapons, a number of substantial shortcomings which include:

- long target acquisition and lock-on time, with the directional radiation pattern of the antenna being mechanically moved in space;
- impossibility to track simultaneously several targets and rockets because of their high speeds;
- lack of swift adaptation to various widths of the directional radiation pattern of the antenna;
- high level of antenna side lobes because of shadowing the working surface of the reflector by the feed and by the design members of both the feed and the reflector-filter, with a resulting deterioration of noise immunity of the radar station.

SUMMARY OF THE INVENTION

It is an object of the invention to provide a relatively cheap antenna with electronic scanning of its directional radiation patterns within a sector of angles as required for radar stations of small-size antiaircraft-rocket systems so that it will be free from the aforementioned shortcomings of the prototype antenna. Along with this, the antenna characteristics of the prototype must be improved, with the requirements being met which are imposed on the cost, mass, overall dimensions and allowable power consumption and which are dictated by the requirements to a small-size mobile radar station.

A further object of the invention is to provide an antenna having a small number of controllable elements and which ensures electronic scanning of its directional radiation patterns within a limited sector of angles dictated by the requirements to radar stations of the above-mentioned systems, with the time needed to move the directional radiation pattern to any point of the scanning sector being no longer than fractions of a millisecond.

The antenna must form summation-difference directional radiation patterns for a monopulse method of target direction finding, must be adaptable to various widths of the directional radiation patterns and have a gain not less than that of the prototype but a lower level of side radiation in the summation directional radiation pattern. The antenna must have overall dimensions and mass to meet the requirements of disposing it in small-size radar stations. Since the cost is of importance for army radar stations, the above-mentioned properties of the antenna must be obtained with its minimum cost.

These objects of the invention are accomplished owing to the fact that the radiating aperture of the antenna is made in the form of four subarrays of the same type, each of which is provided with a feed system, a phasing system with a small number of controllable phase shifters, and a radiation system comprising radiators having a special (table-like) shape of the directional radiation pattern, all the subarrays being provided with a common beam control system. Along with this, each radiator of the radiation system is connected to a respective electrically controlled phase shifter of the phasing system, which shifter is connected to one of the outputs of the feed system. The feed systems are made in the form of parallel or series microwave transmission lines and have one input for each subarray and so many outputs as there are controllable phase shifters. The inputs of the feed system are connected via a system of four E–H tees, three of which are folded in the E-plane, and a circulator by microwave lines to the transmitter and receiver of the radar station. The control inputs of the electrically controlled phase shifters are connected to the outputs of the beam control system. The radiating aperture of the antenna is mounted together with all of its components on the system's chassis platform having both azimuth and elevation electromechanical drives.

In order to ensure adaptation to various widths of the directional radiation patterns, the antenna is provided with a unit for generating phase distribution corrections. For mutual phasing of the subarrays, the antenna is provided with a source of a monitoring signal.

The concept of the invention consists in constructing a phased antenna array which meets all the above-mentioned requirements with a small number of controllable elements (phase shifters), owing to that radiating elements are provided which have special directional radiation patterns. The disclosed invention allows to provide a phased antenna array having a number of controllable elements which is several times smaller than that of the known equidistant phased antenna arrays having the same width of their directional radiation patterns and in which used are the radiators similar to those used in the above-mentioned "PATRIOT" and "AEGIS" antiaircraft-rocket systems and in the majority of other radar stations with phased antenna arrays.

The disclosed equidistant phased antenna array has a distance between the controllable elements equal to several wavelengths, whereas similar phased antenna arrays have a distance between their elements less than one wavelength.

DESCRIPTION OF THE DRAWN EMBODIMENTS

Figure 1:
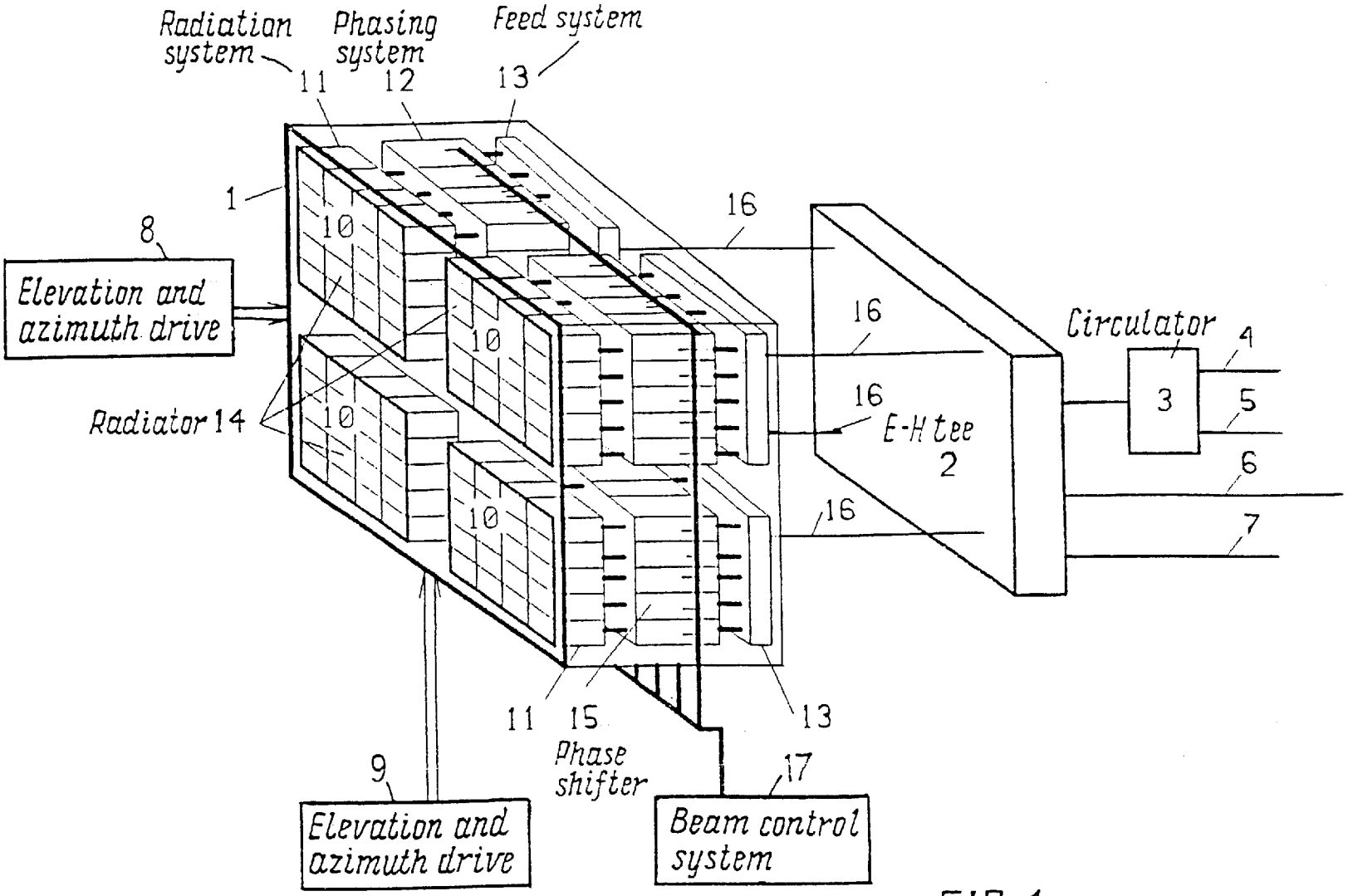
FIG. 1 is a schematic perspective elevational view of a first embodiment, an antenna and microwave section.
Figure 2:
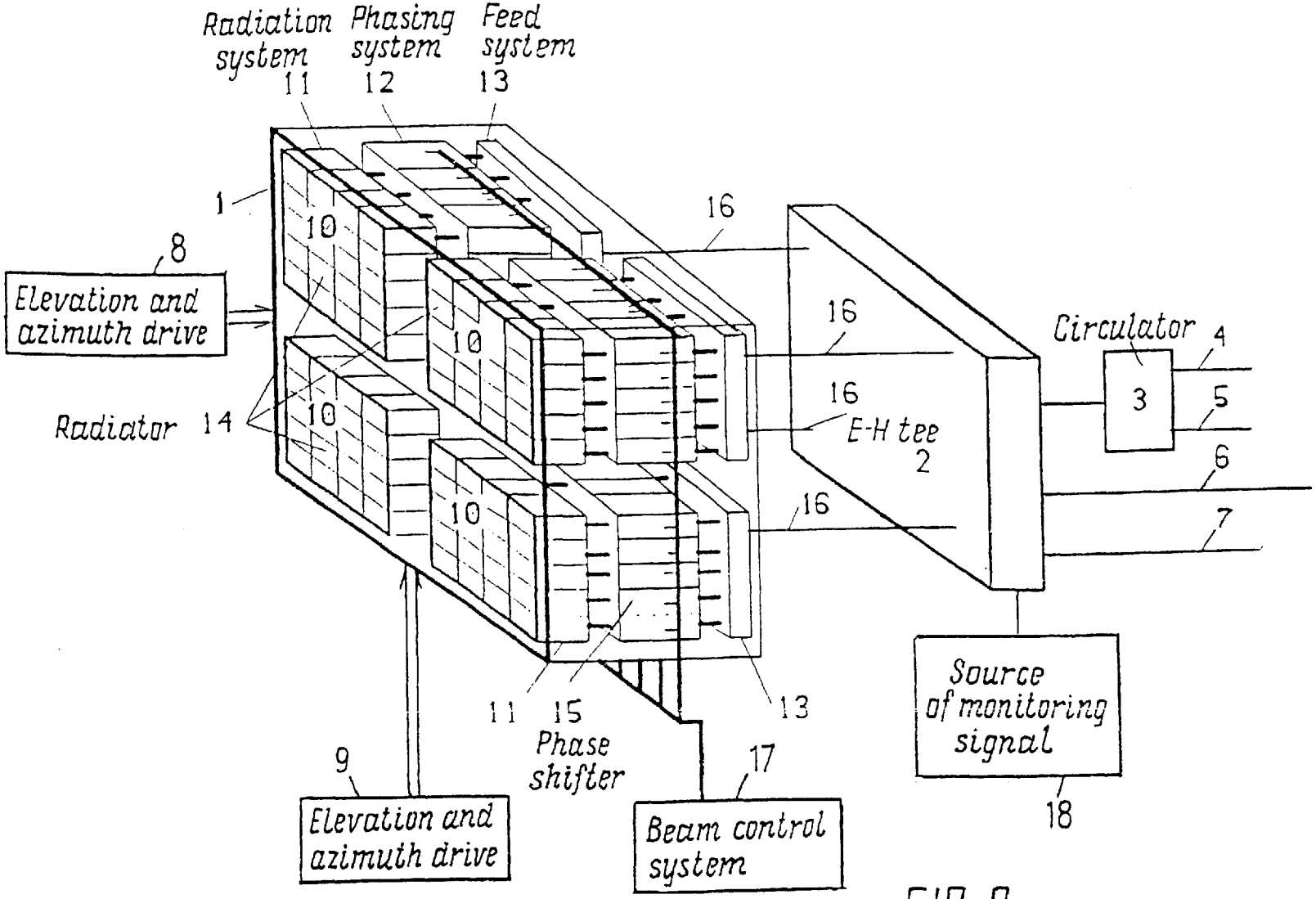
FIG. 2 is a schematic perspective elevational view of a second embodiment, an antenna and microwave section.
Figure 3:
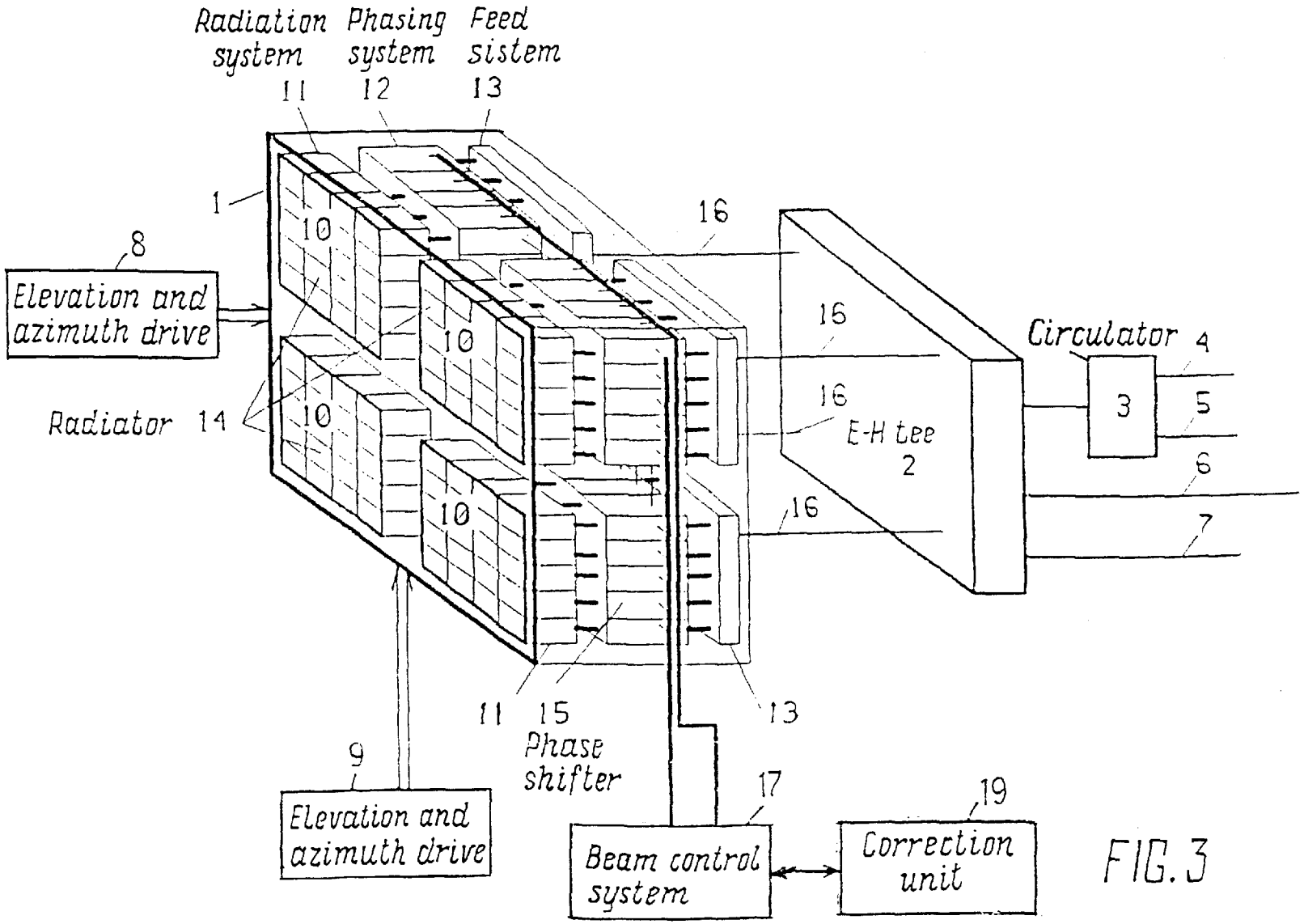
FIG. 3 is a schematic perspective elevational view of a third embodiment, an antenna and microwave section.

The design of the disclosed antenna is shown in FIG. 1, FIG. 2 and FIG. 3. FIG. 1 shows the radiating aperture 1 of the antenna and the microwave section including a system of four E–H tees 2, three of which are folded in the E-plane, a circulator 3 and microwave lines 4, 5, 6, 7 connecting the antenna to a transmitter and receivers (in FIG. 1, the receivers and the transmitter of the radar station are not shown). These components form a constructionally completed assembly having two axes of rotation by elevation angle and azimuth and coupled to respective elevation and azimuth drives 8 and 9. The radiating aperture 1 of the antenna is formed of several (four) subarrays 10, each of which comprises a radiation system 11, a phasing system 12 and a feed system 13. Each of the radiation systems 11 comprises radiators 14 having a table-like shape of the directional radiation pattern and mounted so that the distance between the adjacent radiators is equal to several wavelengths. Each radiator 14 is connected to its respective electrically controlled phase shifter 15 included in the phasing system 12 and which has its input connected to a respective output of the feed system 13. Each of the feed systems 13 consists in a combination of series or parallel microwave transmission lines having one input 16 and outputs, the total number of which in the antenna must be equal to the number of electrically controlled phase shifters. The control inputs of the phase shifters 15 are connected to the outputs of a beam control system 17 which is common for all the subarrays of the antenna.

The inputs 16 of the feed systems 13 are connected via the system of four E–H tees 2, which includes three E–H tees folded in the E-plane, to the circulator 3 and to the microwave lines 4, 5, 6 and 7 connecting the antenna to the transmitter of the radar station (line 4) and to the monopulse receivers: the line 5 is connected to the input of the summation channel receiver, and the lines 6 and 7 are connected to the inputs of azimuth and elevation angle difference channel receivers.

FIG. 2 shows alternative embodiment of the antenna, wherein a source 18 of a monitoring signal is included that is connected to a side input of the system 2 of four E–H tees.

FIG. 3 shows a further alternative embodiment of the antenna, wherein the antenna is provided with a unit 19 for generating phase distribution line and column corrections to vary the width of the directional radiation pattern of the antenna, which unit is connected to the beam control system 17. The beam control system 17 has separate outputs for control signals to control the phase shifters by lines and columns. The control inputs of each phase shifter 15 of the subarrays 10 are connected to respective line and column outputs of the beam control system 17.

The antenna operates as follows:

The radiating aperture 1 of the antenna is oriented by means of the drivers 8 and 9 relative to the chassis of the radar station in the direction of the scanning sector.

In the transmission mode, microwave power is inphasely fed from the transmitter via the microwave line 4, the decoupling circulator 3 and the summation arm of the system E–H tees 2 to the inputs 16 of the four feed systems 13 of the subarrays 10 of the phased antenna array. The feed systems 13 ensure the required amplitude distribution over the inputs of all the controllable phase shifters 15 of the phasing systems 12. The controllable phase shifters 15 set the required phase distribution at the inputs of the radiators 14 of the radiation systems 11 in accordance with the control signals generated by the beam control system 17 to orientate the directional radiation pattern of the antenna toward the selected sector of scanning.

In the reception mode, the antenna operates as follows:

A signal reflected from a target is received by the radiators 14 of the radiation systems 11 of the subarrays 10 and transmitted to the phase shifters 15 of the phasing systems 12. The phase shifters 15 provide a phase shift in the received signal by means of the beam control system 17, depending on the required width of the directional radiation pattern and its angular position within the selected sector of scanning. The phasing systems 12 also compensate for the phase shifts introduced by the feed systems 13 of the subarrays 10 for various phase shifters. In the system of E–H tees 2, the signal received from all the four subarrays 10 of the antenna are combined inphasely when forming the directional radiation pattern over the summation channel, or antiphasely when forming the directional radiation patterns over the azimuth or elevation angle difference channels. When the signals received from the right and left portions of the aperture 1 of the antenna are combined antiphasely, there are formed difference directional radiation patterns in the azimuth plane. When the signals received from the upper and lower portions of the aperture 1 of the antenna are combined antiphasely, there are formed difference directional radiation patterns in the elevation plane.

The radiators 14 form the directional radiation patterns of a required width for the predetermined sector of antenna scanning. The directional radiation patterns of the radiators approach at their leading and trailing fronts to table-like patterns, thus ensuring the suppression of diffraction lobes (array lobes). This allows to increase substantially the distance between the radiators of the phased antenna array, thereby reducing the number of controllable elements by as much as several times.

Adaptation to various widths of the directional radiation patterns is effected by changing the phase distribution at the aperture of the antenna that is carried out by the beam control system 17 according to the signals generated by the correction unit 19. Stored in the correction unit 19 are corrections for the phase distribution over lines and columns, which are caused and taken into account by the beam control system 17 when generating control signals for the phase shifters 15 to vary the width of the directional radiation pattern.

The beam control system 17 generates separate control signals for controlling the phase shifters 15 by lines and columns. The phase shifters 15 of the subarrays 10 which have their control circuits connected to respective line and column outputs of the beam control system 17 operate to provide the total phase shift corresponding to these signals, thus varying the phase distribution in the aperture 1 of the antenna in order to change the width of the directional radiation pattern when deflecting it in the predetermined direction.

The mutual phasing of summation-difference channels is effected on receiving a monitoring signal from the source 18 of a monitoring signal that is put in via the side arm of the system of E–H tees 2 folded in the E-plane so that inphase and equal-in-amplitude input of the monitoring signal into the summation-difference directional radiation pattern forming section is thus ensured with a resulting improvement in the accuracy of target direction finding.

Experimental tests of a large number of antennae constructed in accordance with the present invention have shown that these antennae meet completely the requirements imposed on the antennae for target and rocket tracking radar stations of small-size antiaircraft-rocket systems. The possibility of combining the electromechanical motion of the antenna with electronic scanning within the operating sector of angles in the radar station allows to realize various modes of operating the radar station in searching for and tracking the targets and in locking on and guidance of the rockets. The antenna forms summation and difference directional radiation patterns of various widths for a monopulse method of target direction finding. Within the operating sector of angles, owing to electronic scanning and adaptation to various widths of the directional radiation patterns, any work algorithm can be effected to operate with several targets at various radiation frequencies of the radar station and at various widths of the directional radiation pattern.

As compared against the most relevant prior art prototype, the disclosed antenna has a higher gain and a lower level of side lobes. This is attributed to the fact that the disclosed antenna has neither shadowing of the radiating aperture by the reflector-filter, the feed and their fastening members, nor losses in the dielectric used to provide a system with its polatization plane being rotatable, nor else radiation of power beyond the limits of the aperture.

Use made therein of specially developed radiators having table-like characteristics of radiation and suppressing the diffraction lobes of the antenna (loses of the array) within the working sector of angles has enabled to mount them in the aperture of the antenna with an interval of several wavelengths and to reduce thereby substantially the number of controllable elements. In the disclosed antenna, the controllable elements are arranged to be disposed with an interval of three wavelengths, whereas in the majority of known phased antenna arrays the controllable elements are mounted at an interval that is smaller than the wavelength. In this case, the number of controllable elements in the disclosed antenna gets reduced by a factor of about 10, and this leads to a reduction in the mass and overall dimensions of the antenna and to a decrease in its cost down to the values at which it becomes possible to use the antenna with electronic scanning in the target and rocket acquisition and tracking radar stations of small-size antiaircraft-rocket systems.

In addition to this, the equidistant arrangement of the radiators in the antenna allows to make use of the beam control system providing line and column controlling of the phase shifters. Such a system appears to be substantially simpler and cheaper than the systems providing element-by-element controlling of the phase shifters, because the number of control channels in the former gets reduced by so many times as is equal to half the square root of the number of antenna elements.

What is claimed is:

1. An antenna for small-size target and rocket acquisition of a radar station, said antenna comprising a radiating aperture (1) and a microwave section including a system of four E–H tees (2), three of which are folded in the E-plane, a circulator (3), microwave lines (4), (5), (6), (7) for connecting to a receiver and to a transmitter of the radar station, azimuth and elevation drives (3) and (9), said antenna being characterized in that said radiating aperture (1) comprises subarrays (10) of the same type, each provided with a feed system (13) comprising series or parallel microwave transmission lines, a phasing system (12) with electrically controlled phase shifters (15), a radiation system (11) of discrete radiators (14) disposed within the aperture (1) equidistantly at a distance of two or more wavelengths from each other, and a beam control system (17) which is common for all the subarrays, wherein a number of outputs of the feed systems is equal to a number of controllable phase shifters (15), and a number of inputs thereof is equal to four, and wherein each radiator (14) is connected to its respective electrically controlled phase shifter (15) of the phasing system (12) connected to the output of one of the feed systems (13), the control inputs of the phase shifters (15) are connected to the outputs of the beam control system (17), and the four inputs (16) of the feed systems (13) are for connection via the system of E–H tees (2) and circulator (3) to the receiver and to the transmitter of the radar station.

2. The antenna according to claim 1, characterized in that it is provided with a unit (19) for generating phase distribution line and column corrections to vary the width of the directional radiation pattern of said antenna, which unit being connected to the beam control system (17) generating at the outputs thereof control signals for controlling the phase shifters by lines and columns, wherein the control inputs of each phase shifter (15) of the subarrays (10) are connected to their respective line and column outputs of the beam control system (17).

3. The antenna according to claim 1, characterized in that it is provided with a source (18) of a monitoring signal, which has the output thereof connected to a side arm of the system of foled E–H tees (2).

4. An antenna for small-size target and rocket acquisition and tracking radar stations, said antenna comprising:

a radiating aperture comprising four subarrays;

a microwave signal channel including a system of four E–H tees, three of which are folded in the E-plane;

a circulator;

microwave lines for connection to a receiver and to a transmitter of radar stations;

an azimuth driver;

an elevation drive; and a beam control system which is common for all the subarrays, has outputs and serves to generate phase shifter control signals, wherein each subarray comprises:

a radiation system made in the form of discrete radiators having a directional radiation pattern of trapezoidal shape with steep slopes and disposed within said aperture of the antenna equidistantly at a distance exceeding the operating wavelength;

a phasing system comprising electrically controlled phase shifters each of which is connected to a correspondingly designated radiator and each of which has a control input connected to a corresponding output of the beam control system; and a feed system comprising series and parallel microwave transmission lines and having outputs, the number of which is equal to the number of phase shifters, and an input connected via said system of E–H tees and said circulator to the receiver and to the transmitter of the radar stations.

5. An antenna according to claim 4, which comprises a unit for generating phase distribution line and column corrections to vary the width of the directional radiation pattern of the antenna, the unit being connected to said beam control system which generates at the outputs thereof signals for controlling the phase shifters by lines and columns, wherein said outputs of the beam control system are line and column outputs to which said control inputs of each corresponding said phase shifter are connected.

6. An antenna according to claim 4, which comprises a source of a monitoring signal, which has an output connected to a side arm of said system of four E–H tees.

* * * * *